United States Patent [19]

Simmler et al.

[11] Patent Number: 4,519,225

[45] Date of Patent: May 28, 1985

[54] SLEEVE BARREL LOCK

[75] Inventors: Lawrence W. Simmler, Shrewsbury; John H. Carlson, West Boylston, both of Mass.

[73] Assignee: Omco Inc., Holden, Mass.

[21] Appl. No.: 547,407

[22] Filed: Oct. 31, 1983

[51] Int. Cl.[3] ..... E05B 67/36

[52] U.S. Cl. ..... 70/34; 70/38 C

[58] Field of Search ..... 70/14, 23, 32, 33, 34, 70/386

[56] References Cited

U.S. PATENT DOCUMENTS

| | | | |
|---|---|---|---|
| 1,692,826 | 11/1928 | Ganz | 70/231 |
| 1,923,025 | 8/1933 | Morse | 70/34 |
| 3,002,368 | 10/1961 | Moberg | 70/14 |
| 3,525,242 | 8/1970 | Young | 70/386 |
| 3,835,674 | 9/1974 | Hoyt | 70/34 |
| 4,040,279 | 8/1977 | Signorelli | 70/34 |
| 4,441,343 | 4/1984 | Nielsen | 70/34 |

FOREIGN PATENT DOCUMENTS

| | | | |
|---|---|---|---|
| 89059 | 7/1922 | Austria | 70/34 |

*Primary Examiner*—Robert L. Wolfe

*Attorney, Agent, or Firm*—Thompson, Birch, Gauthier & Samuels

[57] ABSTRACT

A high security barrel lock and a high security key with a movable external sleeve for maintaining the lock in an unlocked position. The lock has a cylindrical barrel with an axial bore. A hollow plunger and a center pin with an enlarged head are axially mounted in the bore. A pair of locking balls are constrained for limited movement between locked and unlocked positions in radial passageways formed in the barrel. The sleeve is fitted over the barrel and is constrained for movement between a locking ball holding position and a locking ball releasing position. In the holding position, the sleeve holds the locking balls in their unlocked position and, in the releasing position, the locking balls are released by the sleeve and free to move radially outward in the barrel passageways into their locked position. Thus, the installer does not require a key in order to install the lock.

19 Claims, 7 Drawing Figures

SLEEVE BARREL LOCK

BACKGROUND OF THE INVENTION

Prior art barrel locks are shown in U.S. Pat. Nos. 1,923,025; 3,002,368; 3,835,674 and 4,040,279. The disclosures of these patents are incorporated by reference and made a part of the present disclosure. These prior art locks and keys have become increasingly less secure with the passage of time because of the relatively wide, albeit substantially controlled, distribution and use of the keys by a large number of people. Assignee's copending application Ser. No. 394,446, the disclosure of which is incorporated herein by reference, describes high security locks and keys. In these prior art locking systems, each lock is operated by a specially designed key. Accordingly, each installer must be provided with the particular key for the lock which is being installed.

It is the object of this invention to provide a sleeve for holding a high security lock in its unlocked position so that it is not necessary to provide the installer with a key in order for him to install the lock, the key being needed only to unlock the lock.

It is also the object of this invention to provide a high security lock with a manually movable sleeve, the sleeve being uniquely designed to hold the locking members in their unlocked position until the lock is ready to be installed, the sleeve being manually movable to release the locking members to their locked position without the use of a key.

SUMMARY OF THE INVENTION

The high security lock of this invention is similar in many respects to prior art locks. However, a sleeve is mounted to the lock barrel for movement between holding and releasing positions. In the holding position, the sleeve engages the locking members and holds them radially inward in the unlocked position. In the releasing position, the sleeve disengages the locking members and they are free to move radially outward to their locked positions. The sleeve is initially set by the manufacturer in its holding position by using a key to move the locking members to their unlocked positions and by moving the sleeve to its holding position over the locking members. Thus, when the sleeve is initially set in the holding position, it holds the locking members radially inward. Then, when the lock is to be installed, the installer manually moves the sleeve to its releasing position and the locking members move radially outward to the locked position. The sleeve is easily moved from its holding position to its releasing position without the use of a key.

DESCRIPTION OF THE DRAWINGS

FIG. 7 shows the sleeve between its holding and releasing positions and the lock in its unlocked position.

DESCRIPTION OF THE PREFERRED AND ALTERNATIVE EMBODIMENTS

The drawings show a high security barrel lock with a preferred and two alternative movable sleeves embodying the present invention. Although the sleeves can be used with most any high security barrel lock, the same high security barrel lock is shown in each embodiment of the invention.

Figure 3:
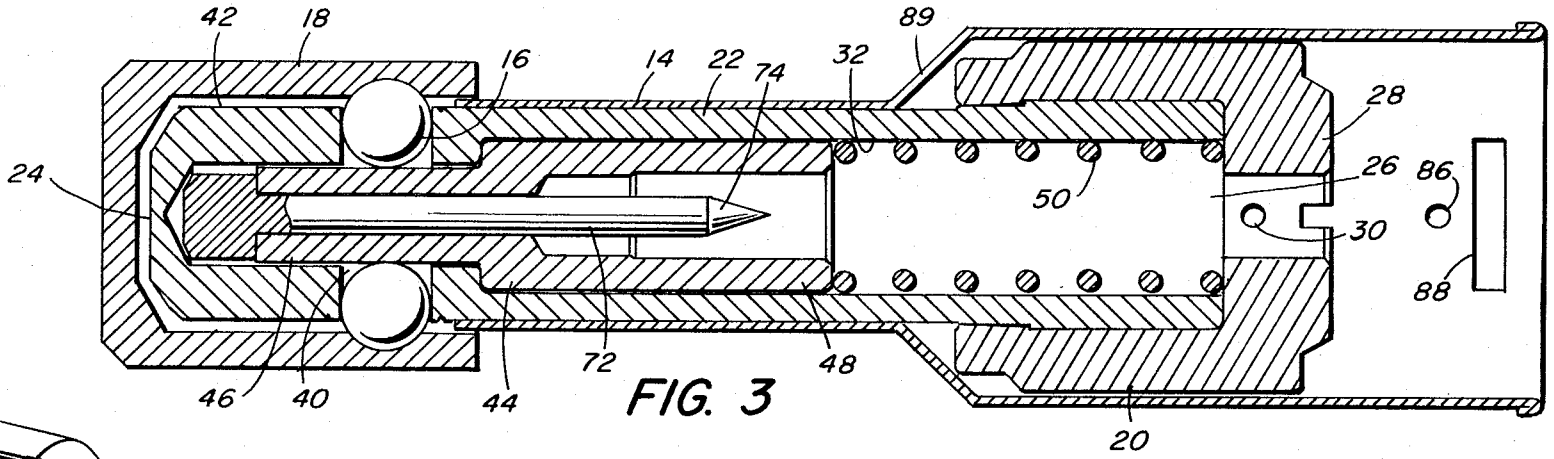
FIG. 3 is a vertical section of the lock of FIG. 1 showing the sleeve in its releasing position and the lock in its locked position.
Figure 2:
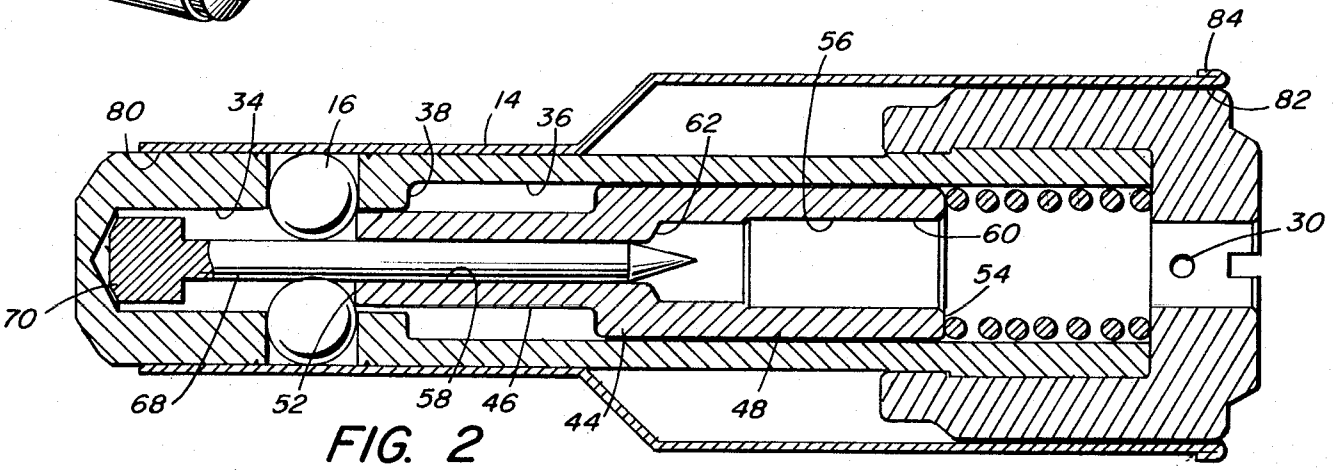
FIG. 2 is a vertical section of the lock of FIG. 1 showing the sleeve in its holding position and the lock in its unlocked position.
Figure 1:
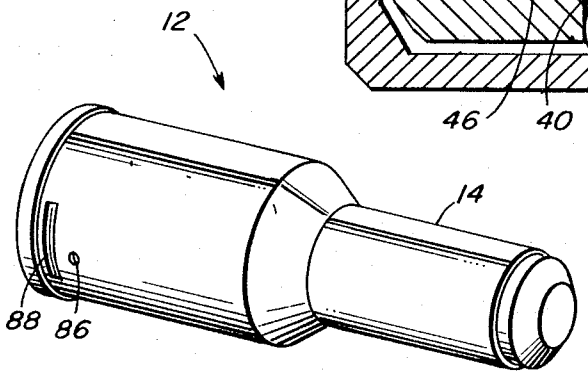
FIG. 1 is a perspective view of the first preferred embodiment of a high security barrel lock and sleeve arrangement of this invention.

FIGS. 1–3 show the first embodiment of a high security barrel lock 12 having an exterior sleeve 14 which is movable in an axial direction between a holding position and a releasing position. In FIG. 2, the barrel lock 12 is in its unlocked condition and the sleeve 14 is in its holding position. That is, locking members 16, for example locking balls, are held radially inwardly by the sleeve 14. When the sleeve 14 is moved to its releasing position shown in FIG. 3, the locking balls 16 are no longer constrained by the sleeve 14. Thus, when the sleeve 14 is in its releasing position, the locking balls 16 are forced radially outwardly and the lock 12 is in its locked position, the locking balls engaging a groove in a front end cap 18.

Barrel lock 12 can be used in many situations to lock two elements against various types of relative movement. Front end cap 18 illustrates but one locking situation of the type wherein two unshown apertured flat panels have the lock inserted through both and the two flat panels are prevented from separating by the large rear end cap 20 of the lock on one side and the large front end cap 18 on the other side. There are many other situations in which barrel lock 12 is useful. The sleeve 14 eliminates the need for providing installers with keys to unlock and lock the barrel lock during installation.

Barrel lock 12 has a hollow cylindrical lock barrel 22 which has a closed front end 24 and an open rear end 26. Rear end cap 20 is fitted over and fixed to open rear end 26 enlarging its effective outer diameter and creating an apertured rear end 28 with a selected aperture size. A transverse passage 30 is also provided to accomodate a conventional "tell tale" or lead seal used to signal tampering.

The barrel lock barrel 22 has a stepped axially extending bore 32 including a front small diameter bore 34 and a rear large diameter bore 36. The diameters are small and large relative to each other. The front bore 34 is joined to the rear bore 36 by an annular shoulder 38, the surface of which extends at an angle to the axis of the barrel bore 32. As will be seen, the function of annular shoulder 38 is to act as a plunger seat.

The lock barrel 22 also has two radially extending passageways 40 which run from the exterior surface 42 of barrel 22 to the front bore 34 of the lock barrel 22. The steel locking balls 16 are movably mounted in the passageways and are free to move radially within the passageways. Although the sleeve 14 prevents the locking balls 16 from falling outwardly from the passageways 40, the passageways may be modified to retain the locking balls. For example, at the outer aperture of each passageway, a very small inwardly extending peripheral rim may be provided to prevent the locking ball from completely escaping outwardly. However, almost half of the locking ball can project outwardly from the passageway as can be seen from FIG. 3.

A hollow cylindrical lock plunger 44 is sized, shaped and mounted to reciprocate within the stepped barrel bore 32. In other words, the front exterior portion 46 of lock plunger 44 slidably fits within the front bore 34 of the barrel 22; and the rear exterior portion 48 slidably fits within the rear bore 36 of the barrel 22. The plunger's forward movement is limited by the annular shoulder 38 of barrel bore 32 as shown in FIG. 3. A lock spring 50 is mounted within barrel bore 32 and continuously urges lock plunger 44 forwardly.

The front exterior portion 46 of the lock plunger 44 moves forwardly across and closes the inner apertures of both locking ball passageways 40 when the lock is in its locked condition as shown in FIG. 3. The lock plunger forces both locking balls 16 radially outwardly to their locked positions whenever the lock plunger covers the locking ball passageways 40. However, when the lock plunger 44 moves rearwardly and uncovers the passageways 40, the locking balls 16 move radially inwardly towards the barrel bore 32. As shown in FIG. 2, the locking balls 16 are held radially inwardly by the sleeve 14 when it is in the holding position.

The hollow lock plunger 44 has an open front end 52, an open rear end 54 and a stepped axially extending bore 56. The plunger bore has a front bore 58 and a rear bore 60. Front bore 58 has a relatively small diameter in comparison to rear bore 60.

The lock plunger 44 also has an annular shoulder 62 in its bore 56 forming the junction between front bore 58 and rear bore 60. The surface of annular shoulder 62 extends at an angle to the axis of the plunger bore 56.

A lock center pin 68 has an enlarged head 70 at its front end and has a rearwardly extending shaft 72. The outer diameter of enlarged head 70 is slightly less than the outer diameter of plunger front exterior portion 46. The outer diameter of center pin shaft 72 is just slightly less than the inner diameter of front plunger bore 58 so that there is a sliding fit therebetween. The center pin shaft 72 extends rearwardly through the open front end 52 of the plunger and can reciprocate in the plunger bore 58.

The center pin enlarged head 70 has a sliding fit within front barrel bore 34 and can reciprocate therein. A friction producing compound is placed in the closed front end of barrel 22 to hold the enlarged head 70 against easy movement in the barrel. That is, when an authorized key is used to unlock the barrel lock 12, the friction producing compound exerts sufficient frictional force on enlarged head 70 to prevent axial movement of center pin 68. In contrast, when an unauthorized key or pick device is forced into plunger bore 56 in an attempt to unlock the barrel lock, it becomes impaled on center pin 68 which moves with plunger 44 causing enlarged head 70 to hold the locking balls 16 radially outward in passageways 40 and to maintain the lock in its locked condition.

The pointed rear end 74 of center pin shaft 72 extends into rear bore 60 when lock plunger 44 is in its fully forward position (FIG. 3). Preferably, as shown in the drawings, the axial length of lock plunger 44 is greater than the axial length of the center pin shaft 72 and the rear end of plunger 44 extends rearwardly of the rear end 74 of the lock center pin 68.

In the fully locked position shown in FIG. 3, the center pin enlarged head 70 is frictionally held by the friction producing compound in the front bore 34. Therefore, reciprocal axial movement of the lock center pin 68 within plunger front bore 58 is yieldingly resisted by the friction producing compound. In other words, the friction producing compound hold the center pin against axial movement in the plunger bore under all conditions except when axial force is exerted on the center pin in excess of a selected amount. Then, the center pin will move axially in the plunger bore.

In the first embodiment of the invention shown in FIGS. 1–3, sleeve 14 is a cylindrical sleeve which is coaxially mounted on barrel 22. The cylindrical sleeve 14 has a small diameter open front end 80 and a large diameter open rear end 82. The small diameter front end 80 is sized, shaped and mounted to reciprocate on barrel 22. The large diameter rear end 82 is sized, shaped and mounted to reciprocate on the large rear end cap 20, the edge of the open end 82 being reversely bent to form an annular lip 84. The large diameter rear end 82 is provided with transverse openings 86 which can be aligned with the passage 30, and slots 88 which are configured to accommodate a conventional "tell tale" or lead seal used to signal tampering. The diameter of the small front end 80 is less than the diameter of end cap 20. The front end 80 is joined to the rear end 82 by a shoulder 89, the surface of which extends at an angle to the axis of the barrel bore 32.

When barrel lock 12 is key-set to the unlocked position (FIG. 2), sleeve 14 can be manually pushed forwardly until the front end 80 is positioned over and forward of the locking balls 16. As shown in FIG. 2, front end 80 is in the holding position and the locking balls 16 are held inwardly in the unlocked condition. When sleeve 14 is manually moved rearwardly, front end 80 moves to the rear of the locking balls 16 and the locking balls are urged radially outwardly in passageways 40 by lock plunger 44 as shown in FIG. 3. FIG. 3 shows the sleeve in the releasing position and the locking balls in the locked condition.

FIGS. 1–3 have illustrated a barrel lock 12 with a sleeve 14 that is mounted for slidable axial movement on the barrel 22 between a holding position in which the locking members are held radially inward in the unlocked condition and a releasing position in which the locking members are free to move radially outward to the locked condition. FIGS. 4–7 show a spring lock with sleeves that are rotatable between locked and unlocked positions.

Figure 6:
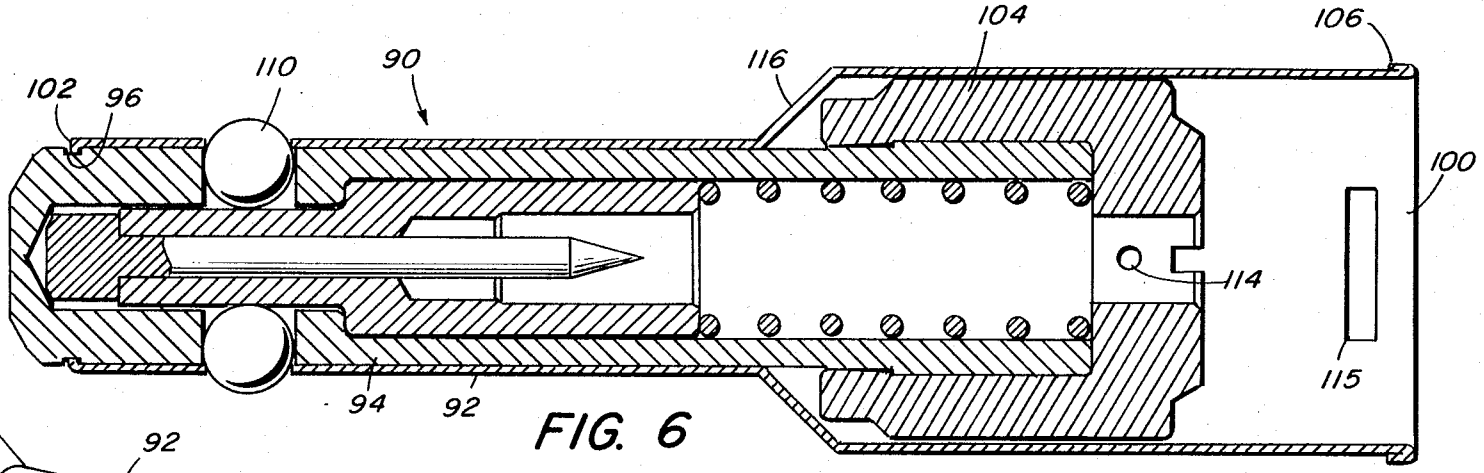
FIG. 6 is a vertical section of the lock of FIG. 4 showing the sleeve in its releasing position and the lock in its locked position.
Figure 5:
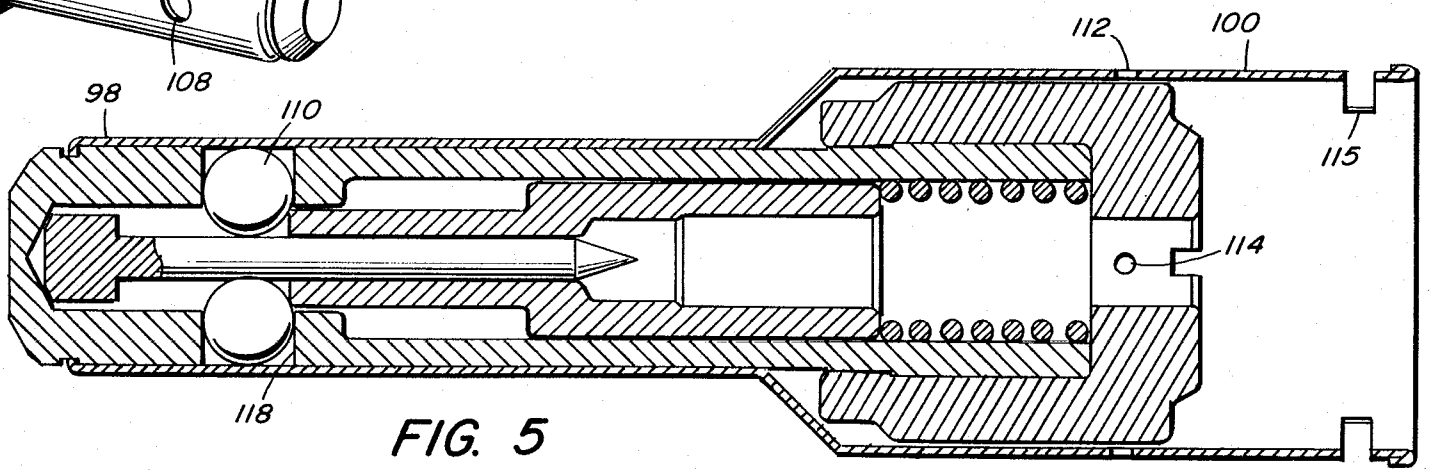
FIG. 5 is a vertical section of the lock of FIG. 4 showing the sleeve in its holding position and the lock in its unlocked position.
Figure 4:
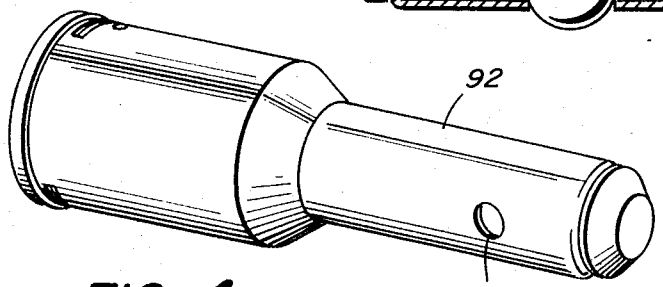
FIG. 4 is a perspective view of a second embodiment of the high security barrel lock and sleeve arrangement of this invention showing a modified sleeve.

In the second embodiment of the invention illustrated in FIGS. 4–6, a barrel lock 90 has a rotatable cylindrical exterior sleeve 92 which is coaxially mounted on the lock barrel 94. Barrel lock 90 is similar to barrel lock 12 in construction and operation. However, the lock barrel 94 of barrel lock 90 is provided with an annular groove 96 which functions as a track or guideway for the sleeve 92. The sleeve 92 has a small diameter open front end 98 and a large diameter open rear end 100. The small diameter front end 98 is sized, shaped and mounted to rotate on barrel 94. The front edge of the front end 98 is turned inwardly and forms a lip 102 which is perpendicular to the axis of the barrel 94. The lip 102 rides in the track 96 and prevents axial movement of the sleeve 92 relative to the barrel 94. The large diameter rear end 100 is sized, shaped and mounted to rotate about the large rear end cap 104, the rear edge of the rear end being reversely bent to form an annular lip 106. The small diameter front end 98 is provided with a pair of openings 108 which are sized and shaped to permit free movement of the locking balls 110 when the openings are positioned over the locking members. The large diameter rear end 100 is provided with transverse openings 112 which can be aligned with a transverse passage 114 in the barrel 94 and diametrically opposed narrow slots 115 which are configured to accommodate a conventional "tell tale" or lead seal used to signal tampering. The diameter of the small front end 98 is smaller than the diameter of end cap 104. The front end 98 is joined to the rear end 100 by a shoulder 116, the surface of which extends at an angle to the axis of the barrel 94.

When barrel lock 90 is key-set to the unlocked position, sleeve 92 can be manually rotated until the solid portions of the front end 98 are positioned over and block outward radial movement of the locking balls 110. As shown in FIG. 5, front end 98 is in the holding position and the locking balls 110 are held radially inwardly in the unlocked condition in passageway 118. When sleeve 92 is manually rotated and the openings 108, for example circular or slotted openings, are positioned over the locking balls 110, the locking balls are urged radially outward in passageways 118 by the lock plunger as shown in FIG. 6. FIG. 6 shows the sleeve in the releasing position and the locking balls in the locked condition.

Figure 7:
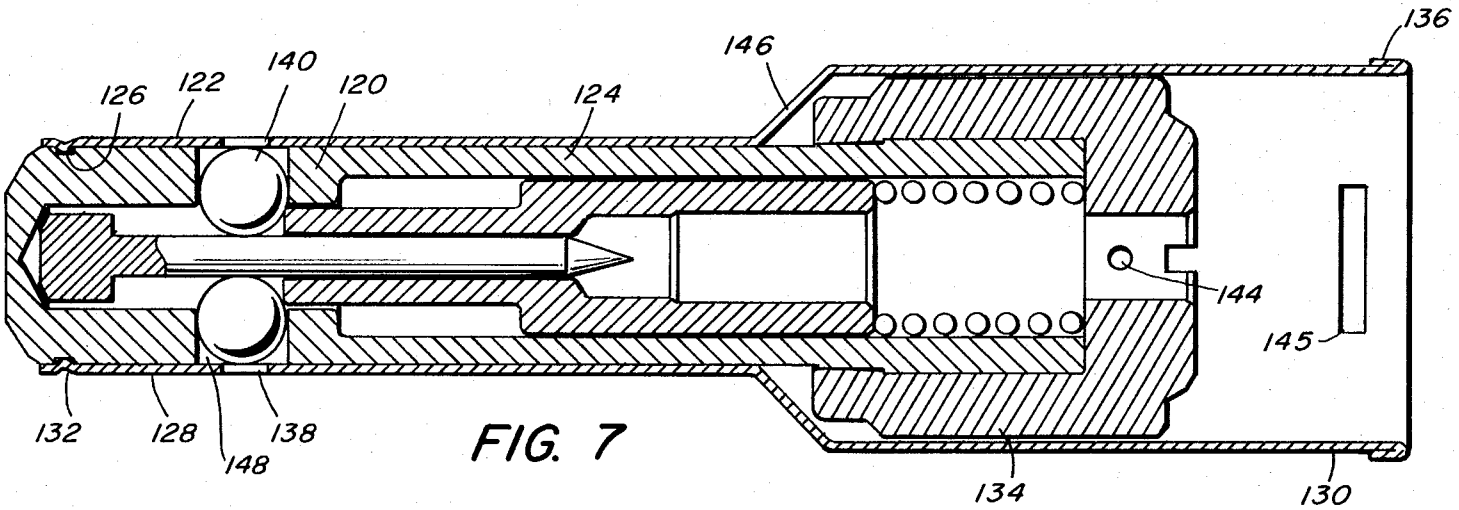
FIG. 7 is a vertical section of a third embodiment of the high security barrel lock and sleeve arrangement of this invention showing another modified sleeve.

In the third embodiment of the invention illustrated in FIG. 7, a barrel lock 120 has a rotatable cylindrical exterior sleeve 122 which is coaxially mounted on the lock barrel 124. Barrel lock 120 is similar to barrel lock 12 in construction and operation. However, the lock barrel 124 of the barrel lock 120 is provided with an annular groove 126 which functions as a track or guideway for the sleeve 122. Annular groove 126 is similar to the annular groove 96 in barrel lock 90. The sleeve 122 has a small diameter open front end 128 and a large diameter open rear end 130. The small diameter front end 128 is sized, shaped and mounted to rotate on barrel 124. An annular channel 132 which is formed near the front edge of the front end 128, is sized and shaped to ride in the track 126 and prevent axial movement of the sleeve 122 relative to the barrel 124. The large diameter rear end 130 is sized, shaped and mounted to rotate about the large rear end cap 134, the rear edge of the rear end being reversely bent to form an annular lip 136. The small diameter front end 128 is provided with a pair of openings 138 which are sized and shaped to permit free movement of the locking balls 140 when the openings are positioned over the locking members. The large diameter rear end 130 is provided with transverse openings (not shown) which can be aligned with a transverse passage 144 in the barrel 124 and slots 145 which are configured to accommodate a conventional "tell tale" or lead seal used to signal tampering. The diameter of the small front end is less than the diameter of end cap 134. The front end 128 is joined to the rear end 130 by a shoulder 146, the surface of which extends at an angle to the axis of the barrel 124. When barrel lock 120 is key-set to the unlocked position, sleeve 122 can be manually rotated until the solid portions of the front end 128 are positioned over and block outward radial movement of the locking balls 140. As shown in FIG. 7, the front end 128 is part way between the holding and releasing positions and the locking balls 140 are held radially inwardly in the unlocked condition in passageways 148. When sleeve 122 is manually rotated all the way to the releasing position and the openings 138, for example circular or slotted openings, are positioned over the locking balls 140, the locking balls are urged radially outwardly in passageways 148 by the lock plunger and extend through openings 138.

The above description obviously suggests many possible variations and modifications of this invention which would not depart from its spirit and scope. It should be understood, therefore, that the invention is not limited in its application to the details of structure specifically described or illustrated and that within the scope of the appended claims, it may be practiced otherwise than as specifically described or illustrated.

What is claimed is:

1. A high security lock comprising:

(a) a hollow cylindrical lock barrel having a closed front end and an apertured rear end, said lock barrel having an axially extending bore, the front bore having an relatively small diameter and the rear bore having a relatively large diameter;

(b) at least two radially extending passageways running from the exterior surface of said lock barrel to the front bore of said lock barrel;

(c) a locking member mounted in each said passageway for limited movement therein; and (d) sleeve means mounted to said barrel, said sleeve means movable relative to said barrel between a locking member holding position and a locking member releasing position, said sleeve means contacting and restraining said locking members radially inward in said passageways when in said holding position, said sleeve means being out of contact with said locking members when in said releasing position.

2. The high security lock as claimed in claim 1 wherein said sleeve means is a cylindrical sleeve coaxially mounted on said barrel.

3. The high security lock as claimed in claim 2 wherein said cylindrical sleeve has a small diameter open front end and a large diameter open rear end.

4. The high security lock as claimed in claim 2 wherein said sleeve is axially slidable on said barrel.

5. The high security lock as claimed in claim 2 wherein said sleeve is rotatable on said barrel and has openings therein through which said locking members protrude when said sleeve is in said releasing position.

6. The high security lock as claimed in claim 2 wherein said barrel is formed with an annular groove adjacent said closed front end, said sleeve having a guide at one end which is configured to ride in said annular groove, said sleeve rotatable about the axis of said barrel and fixed against slidable movement along the axis of said barrel.

7. The high security lock as claimed in claim 6 wherein said one end of said sleeve is turned inwardly at an angle to form said guide which is configured to ride in said annular groove.

8. The high security lock as claimed in claim 6 wherein said one end of said sleeve is formed with an annular rib which is configured to ride in said annular groove.

9. The high security lock as claimed in claim 5 wherein said openings have a circular profile.

10. The high security lock as claimed in claim 5 wherein said openings have a slotted profile.

11. The high security lock comprising:

(a) a hollow cylindrical lock barrel having a closed front end and an apertured rear end, said lock barrel having a stepped axially extending bore, the front bore having a relatively small diameter and the rear bore having a relatively large diameter;

(b) said stepped barrel bore having an annular shoulder forming the junction between said front bore and said rear bore;

(c) an end cap fitted on said rear end, said end cap having a diameter which is larger than the diameter of said barrel;

(d) at least two radially extending passageways running from an outer aperture in the exterior surface of said lock barrel to an inner aperture in the front bore of said lock barrel, and a locking member mounted in each said passageway for limited movement therein, said locking member restrained from completely escaping through said outer aperture; and (e) a sleeve mounted to said barrel and movable between holding and releasing positions, said sleeve having a relatively small diameter open front end and a relatively large diameter open rear end, said open front end sized and shaped to fit over said barrel, the diameter of said open front end being larger than the diameter of said barrel and being smaller than the diameter of said end cap, said sleeve contacting and restraining said locking members radially inward in said passageways when in said holding position, said locking members being unrestrained when said sleeve is in said releasing position.

12. The high security lock as claimed in claim 11 wherein said sleeve is axially slidable on said barrel, a front edge of said sleeve being positioned forward of said locking members when in said holding position, the front edge of said sleeve being positioned rearward of said locking members when in said releasing position.

13. The high security lock as claimed in claim 11 wherein said barrel is formed with an annular groove adjacent the said closed front end, said sleeve having a guide which is configured to ride in said annular groove, said sleeve being rotatable about the axis of said barrel and being fixed against slidable movement along the axis of said barrel.

14. The high security lock as claimed in claim 13 wherein said front end of said sleeve is turned inwardly at an angle to form said guide which rides in said annular groove.

15. The high security lock as claimed in claim 13 wherein said guide is an annular rib which is configured to ride in said annular groove.

16. The high security lock as claimed in claim 11 wherein said sleeve is formed with openings that are sized and shaped to permit said locking members to move radially outward in said passageways when said sleeve is in said releasing position.

17. The high security lock as claimed in claim 16 wherein said openings have a circular profile.

18. The high security lock as claimed in claim 16 wherein said openings have a slotted profile.

19. A high security lock comprising:

(a) a hollow cylindrical lock barrel having a closed front end and an apertured rear end, said lock barrel having an axially extending bore, the front bore having a relatively small diameter and the rear bore having a relatively large diameter;

(b) at least two radially extending passageways running from the exterior surface of said lock barrel to the front bore of said lock barrel, and a locking member mounted in each said passageway for limited movement therein; and (c) a sleeve mounted to said barrel and movable between holding and releasing positions, said sleeve having a relatively small diameter open front end and a relatively large diameter open rear end, said open front end sized and shaped to fit over said barrel, the diameter of said open front end being larger than the diameter of said barrel and smaller than the diameter of said end cap, said sleeve contacting and restraining said locking members radially inward in said passageways when in said holding position, said locking members being unrestrained by said sleeve when in said releasing position.

* * * * *